US006776650B2

(12) United States Patent
Cheng et al.

(10) Patent No.: US 6,776,650 B2
(45) Date of Patent: Aug. 17, 2004

(54) WATERPROOF AND HEAT-DISSIPATING STRUCTURE OF ELECTRONIC APPARATUS

(75) Inventors: Bruce C. H. Cheng, Taipei (TW); Chun-Chen Chen, Taoyuan (TW); Jui-Yuan Hsu, Taoyuan (TW); Lien-Jin Chiang, Taoyuan (TW)

(73) Assignee: Delta Electronics, Inc., Taipei (TW)

( * ) Notice: Subject to any disclaimer, the term of this patent is extended or adjusted under 35 U.S.C. 154(b) by 0 days.

(21) Appl. No.: 10/388,291

(22) Filed: Mar. 13, 2003

(65) Prior Publication Data

US 2004/0067688 A1 Apr. 8, 2004

(30) Foreign Application Priority Data

Oct. 2, 2002 (TW) ..... 091215635 A

(51) Int. Cl.[7] ..... H01R 13/00

(52) U.S. Cl. ..... 439/485; 439/906; 439/487; 439/76.1; 361/683; 361/699

(58) Field of Search ..... 439/485, 487, 439/196, 731, 906, 687, 696, 76.1; 361/683, 699

(56) References Cited

U.S. PATENT DOCUMENTS 5,289,342 A * 2/1994 Spalding et al. ..... 361/699
5,311,397 A * 5/1994 Harshberger et al. ..... 361/683

* cited by examiner

*Primary Examiner*—Tho D. Ta
(74) *Attorney, Agent, or Firm*—Michael Best & Friedrich LLP

(57) ABSTRACT

A waterproof and heat-dissipating structure of an electronic apparatus including a circuit board, an input element and an output element is disclosed. The structure includes an aluminum-wrapped housing having at least four adjoining surfaces for defining a space, a first opening end and a second opening end, wherein the space is used for accommodating the circuit board, a first lateral plate fixed to the aluminum-wrapped housing, covering the first opening end and having a first hole for fixing the input element therein, and a second lateral plate fixed to the aluminum-wrapped housing, covering the second opening end and having a second hole for fixing the output element therein.

19 Claims, 8 Drawing Sheets

WATERPROOF AND HEAT-DISSIPATING STRUCTURE OF ELECTRONIC APPARATUS

FIELD OF THE INVENTION

The present invention relates to a waterproof and heat-dissipating structure of an electronic apparatus, and more particularly to a waterproof and heat-dissipating structure of an adapter.

BACKGROUND OF THE INVENTION

Adapter is an electronic apparatus used in our daily life. For being applied to various utility conditions, generally, the adapter has a special structure design for assembling. Please refer to FIG. 1A which is a decomposed diagram illustrating an assembly structure of a conventional adapter. As shown in FIG. 1A, the adapter 1 includes a top cover 11, a base 12, a circuit board 13, a socket 14 and a power cord 15. The top cover 11 is engaged to the base 12 to define a space for accommodating the circuit board 13 therein. When the top cover 11 and the base 12 are engaged together, a first hole and a second hole are defined at the opposite surfaces, respectively, for fixing the socket 14 and the power cord 15 therein, respectively. The edge of the socket 14 has a groove 141 surrounding. When the socket 14 is electrically connected to the circuit board 13 (not shown in FIG. 1A) and disposed in the first hole, the groove 141 is engaged with the edge of the first hole. Then, the socket 14 is fixed in the first hole when the top cover 11 and the base 12 are combined together. The power cord 15 includes a terminal 151 having an electrical connecting end 1511, a buffer portion 1512 and a groove 1513. The groove 1513 is formed between the electrical connecting end 1511 and the buffer portion 1512. When the electrical connecting end 1511 is electrically connected to the circuit board 13 (not shown in FIG. 1A) and the terminal 151 is disposed in the second hole, the groove 1513 of the terminal 151 is engaged with the edge of the second hole. Hence, the power cord 15 is fixed in the second hole when the top cover 11 and the base 12 are combined. The combined structure of the adapter is shown in FIG. 1B.

The conventional assembly structure of the adapter 1, however, is unavoidably to exist gaps between the socket 14 and the first hole, the terminal 151 of the power cord 15 and the second hole, and the top cover 11 and the base 12 because the junctions are not tight enough. Hence, it cannot achieve waterproof effect. For an adapter which is required to be operated under a wet operational condition for a long time, a short circuit or a damage of the electronic devices inside the adapter may occur since the electronic device could contact with water or be rusty. It is not only to dramatically reduce the use life of the adapter but also to greatly limit the application of the adapter. In addition, even through the conventional adapter is not operated under the wet operational condition, if the conventional adapter accidentally or unexpectedly contacts with water, then a short circuit or a damage of the electronic devices inside the adapter may also occur.

Moreover, the electronic devices on the circuit board usually generate a lot of heat when the conventional adapter is operated. Since the material for making the conventional adapter is the plastic material, the heat generated from the electronic devices is not easily dissipated. The electronic devices inside the conventional adapter are easily broken because of heat accumulation, resulting in that the use life of the conventional adapter dramatically reduces. Hence, another conventional adapter as shown in FIG. 2 is provided to solve the heat-dissipation problem. As shown in FIG. 2, both the top cover and the base include a plurality of holes 20 for dissipating heat. In such way, this conventional adapter is not waterproof and the heat dissipating is inefficiently.

Therefore, the purpose of the present invention is to develop a waterproof and heat-dissipating structure of an adapter to deal with the above situations encountered in the prior art.

SUMMARY OF THE INVENTION

An object of the present invention is to provide waterproof and heat-dissipating structure of an adapter for simultaneously improving the heat dissipating and the waterproof effects.

According to an aspect of the present invention, there is provided a waterproof and heat-dissipating structure of an electronic apparatus including a circuit board, an input element and an output element. The structure includes an aluminum-wrapped housing having at least four adjoining surfaces for defining a space, a first opening end and a second opening end, wherein the space is used for accommodating the circuit board, a first lateral plate fixed to the aluminum-wrapped housing, covering the first opening end and having a first hole for fixing the input element therein, and a second lateral plate fixed to the aluminum-wrapped housing, covering the second opening end and having a second hole for fixing the output element therein.

For example, the input element can be a power cord, a plug or an outlet.

For example, the output element can be a power cord, a plug or an outlet.

For example, the electronic apparatus can be an adapter, a battery charger or a transformer.

Preferably, the surfaces of the aluminum-wrapped housing further have one of dents and fins thereon.

Preferably, the first lateral plate is fixed to the aluminum-wrapped housing by screwing for tightly covering the first opening end.

Preferably, the second lateral plate is fixed to the aluminum-wrapped housing by screwing for tightly covering the second opening end.

Preferably, the waterproof and heat-dissipating structure further includes an input element spacer disposed between the input element and the first lateral plate for avoiding forming a gap between the input element and the first hole.

Preferably, the waterproof and heat-dissipating structure further includes a first lateral plate spacer disposed between the first lateral plate and the aluminum-wrapped housing for avoiding forming a gap therebetween.

Preferably, the waterproof and heat-dissipating structure further includes an output element spacer disposed between the output element and the second lateral plate for avoiding forming a gap between the output element and the second hole.

Preferably, the waterproof and heat-dissipating structure further includes a second lateral plate spacer disposed between the second lateral plate and the aluminum-wrapped housing for avoiding forming a gap therebetween.

Preferably, the waterproof and heat-dissipating structure further includes an outer covering for covering the aluminum-wrapped housing, the first lateral plate and the second lateral plate. The outer covering preferably includes a top cover and a base. The outer covering preferably has a plurality of heat-dissipating holes on an outer surface thereof.

Preferably, the input element is fixed to the first lateral plate by screwing for tightly fastening the input element therein.

Preferably, the output element is engaged into the second hole of the second lateral plate. The output element preferably has a groove, for engaging with an edge of the second hole when the output element inserts into the second hole to fix the output element therein.

Preferably, the output element includes a waterproof structure at a power cord end and the waterproof structure includes a first nut having a channel and an inner thread, a soft washer, a wire material having one end to pass through the channel of the first nut for sleeving with the soft washer, a connecting element having a first and a second connecting ends, wherein the second connecting end connected the wire material by the soft washer and to the first nut by screwing, whereby tightly fixing the wire material to the connecting element and having waterproof effect, and a second nut connected to the first connecting end of the connecting element, which first passes through the second hole of the second lateral plate, by screwing, whereby tightly fixing the output element to the second lateral plate and having waterproof effect. Preferably, the waterproof structure at a power cord end further includes a connecting spacer disposed between the connecting element and the second lateral plate for avoiding forming a gap.

Preferably, the aluminum-wrapped housing is an aluminum squeezing-type housing, which is integrally formed.

According to another aspect of the present invention, there is provided a waterproof and heat-dissipating structure of an electronic apparatus including a circuit board, an input element and an output element. The structure includes an aluminum-wrapped housing having a space therein and two opposite opening ends, a first opening end and a second opening end, wherein the space is used for accommodating the circuit board, and an outer covering wrapping the aluminum-wrapped housing and having a first hole and a second hole for fixing the input element and the output element therein, respectively.

According to a further aspect of the present invention, there is provided an adapter including an input element, an output element, a circuit board, an aluminum-wrapped housing having a space therein and two opposite opening ends, a first and a second opening ends, wherein the space is used for accommodating the circuit board therein, a first lateral plate fixed to the aluminum-wrapped housing for tightly covering the first opening end and having a first hole for fixing the input element therein, and a second lateral plate fixed to the aluminum-wrapped housing for tightly covering the second opening end and having a second hole for fixing the output element therein.

BRIEF DESCRIPTION OF THE DRAWINGS

The present invention may best be understood through the following description with reference to the accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

The present invention provides a waterproof and heat-dissipating structure of an electronic apparatus, especially for an adapter. The electronic apparatus can be a battery charger or a transformer besides the adapter. The adapter includes a waterproof and heat-dissipating structure, a circuit board, an input element and an output element. According to the present invention, the input element can be a plug, a socket or a power cord. The output element can be a socket, a plug or a power cord corresponding to the input element. For easily explaining the present invention, in the following embodiments, a socket is used as the input element for electrically connecting to a power cord plug to input the electrical power, and a power cord is used as the output element for electrically connecting to an information equipment such as a notebook.

Figure 1A:
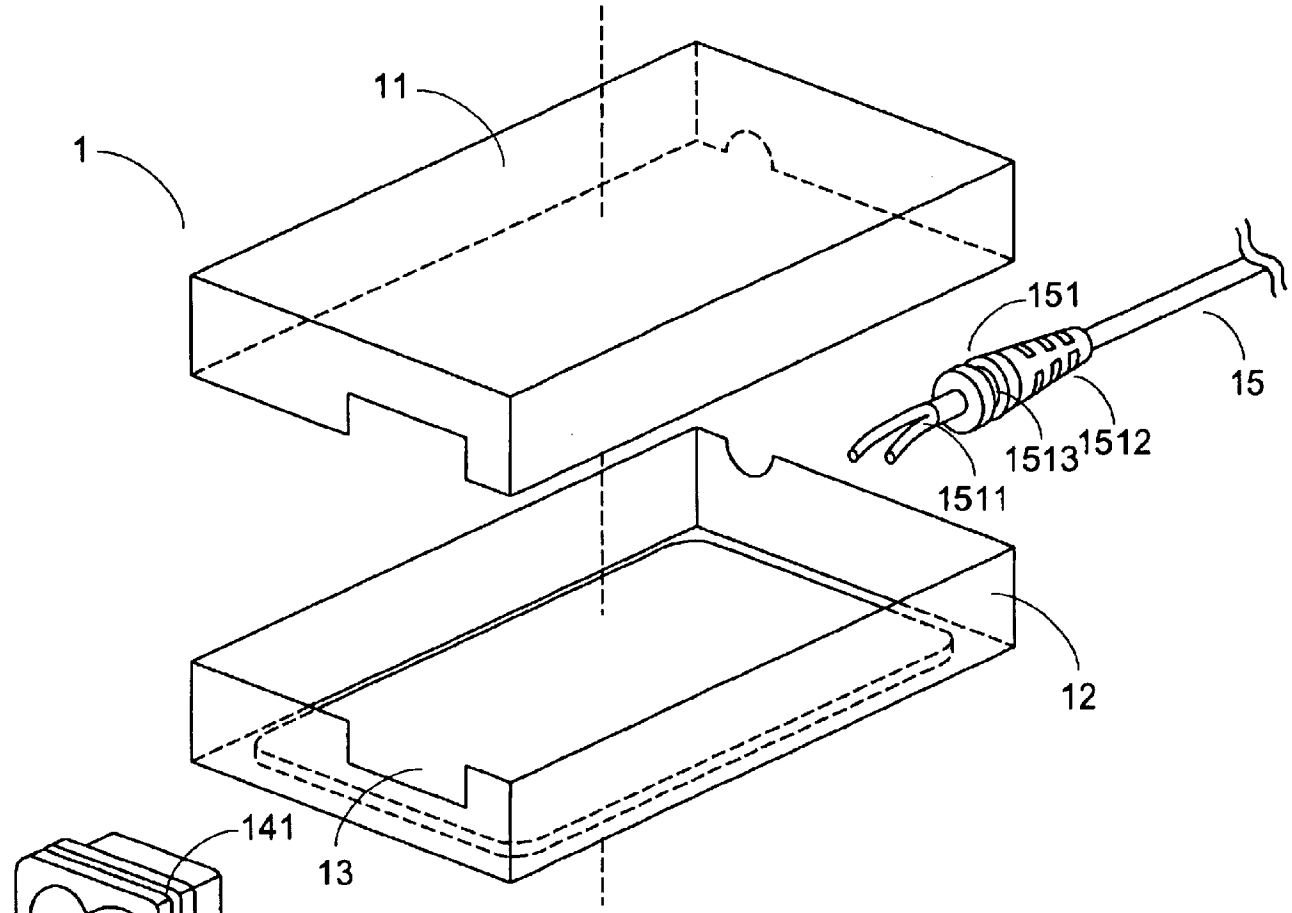
Fig.1A Prior Art
FIG. 1A is a decomposed diagram illustrating an assembly structure of a conventional adapter.
Figure 1B:
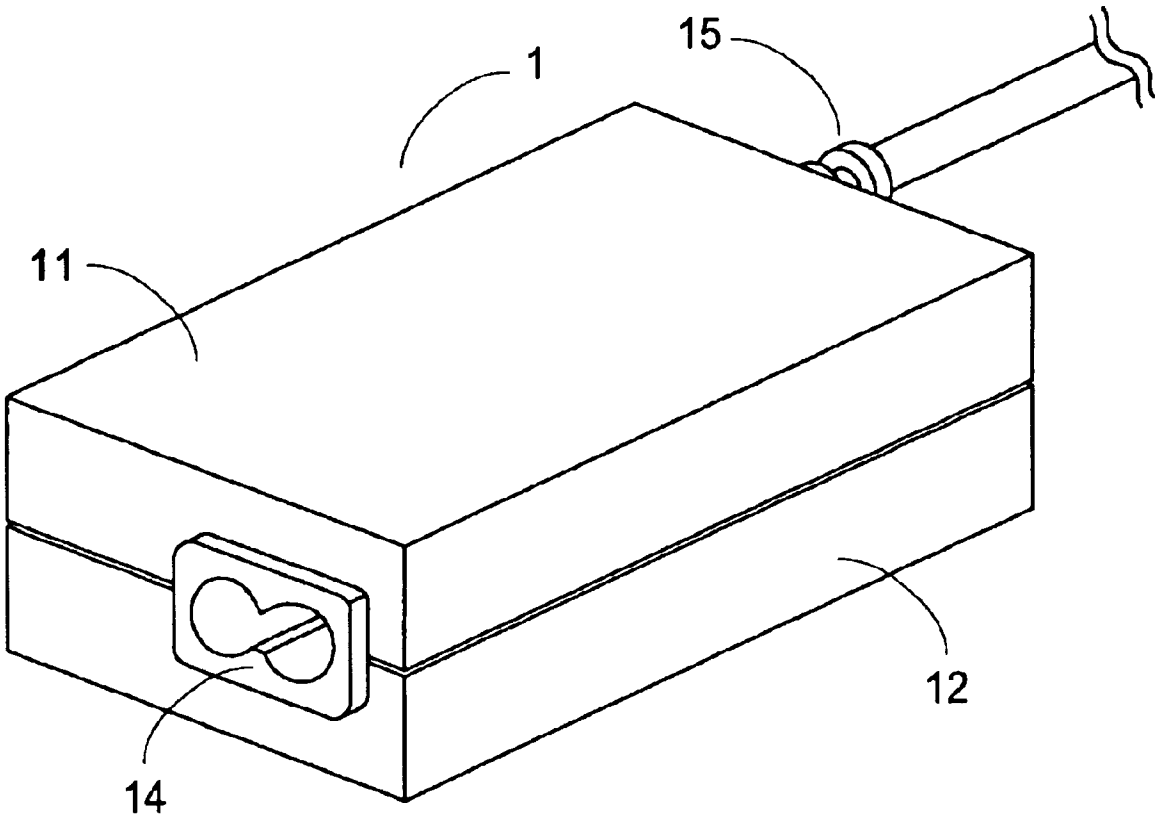
Fig.1B Prior Art
FIG. 1B is a combined diagram illustrating the assembly structure of the conventional adapter of FIG. 1A.
Figure 2:
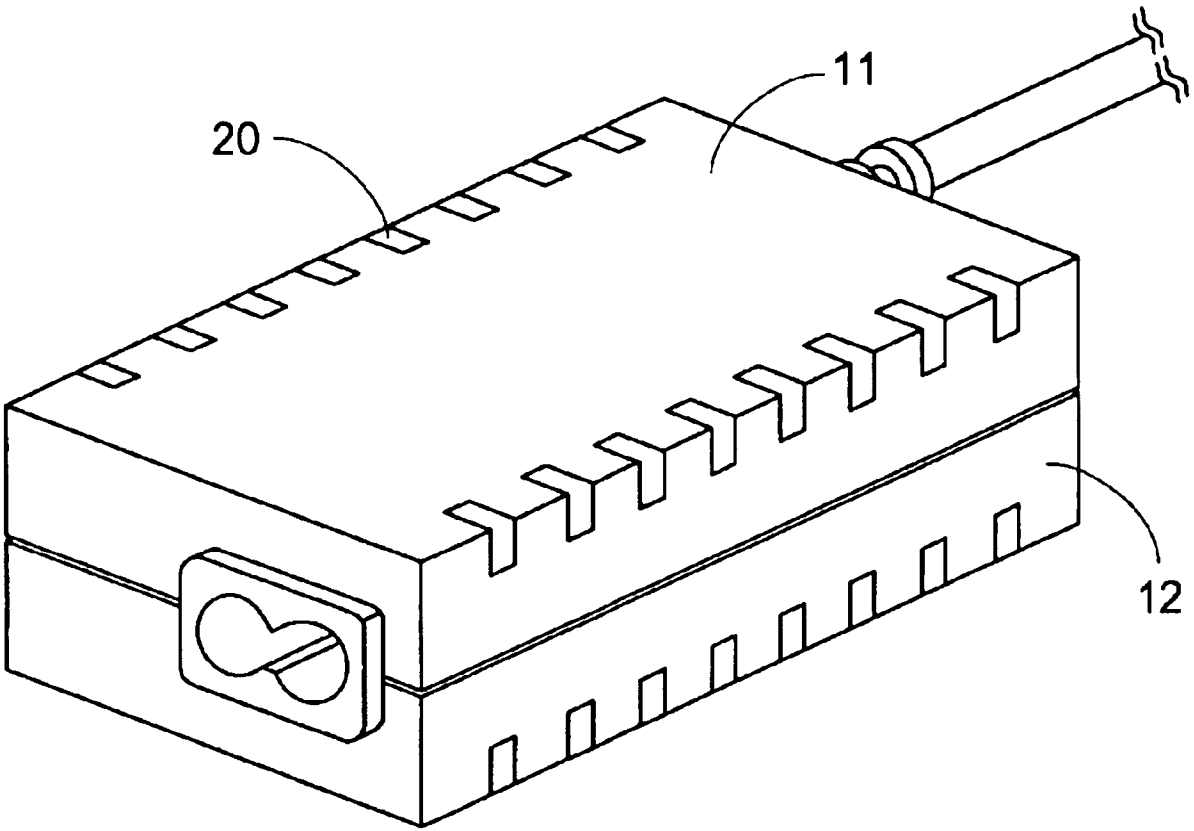
Fig.2 Prior Art
FIG. 2 is a diagram illustrating a conventional adapter including a plurality of heat-dissipating holes.
Figure 3:
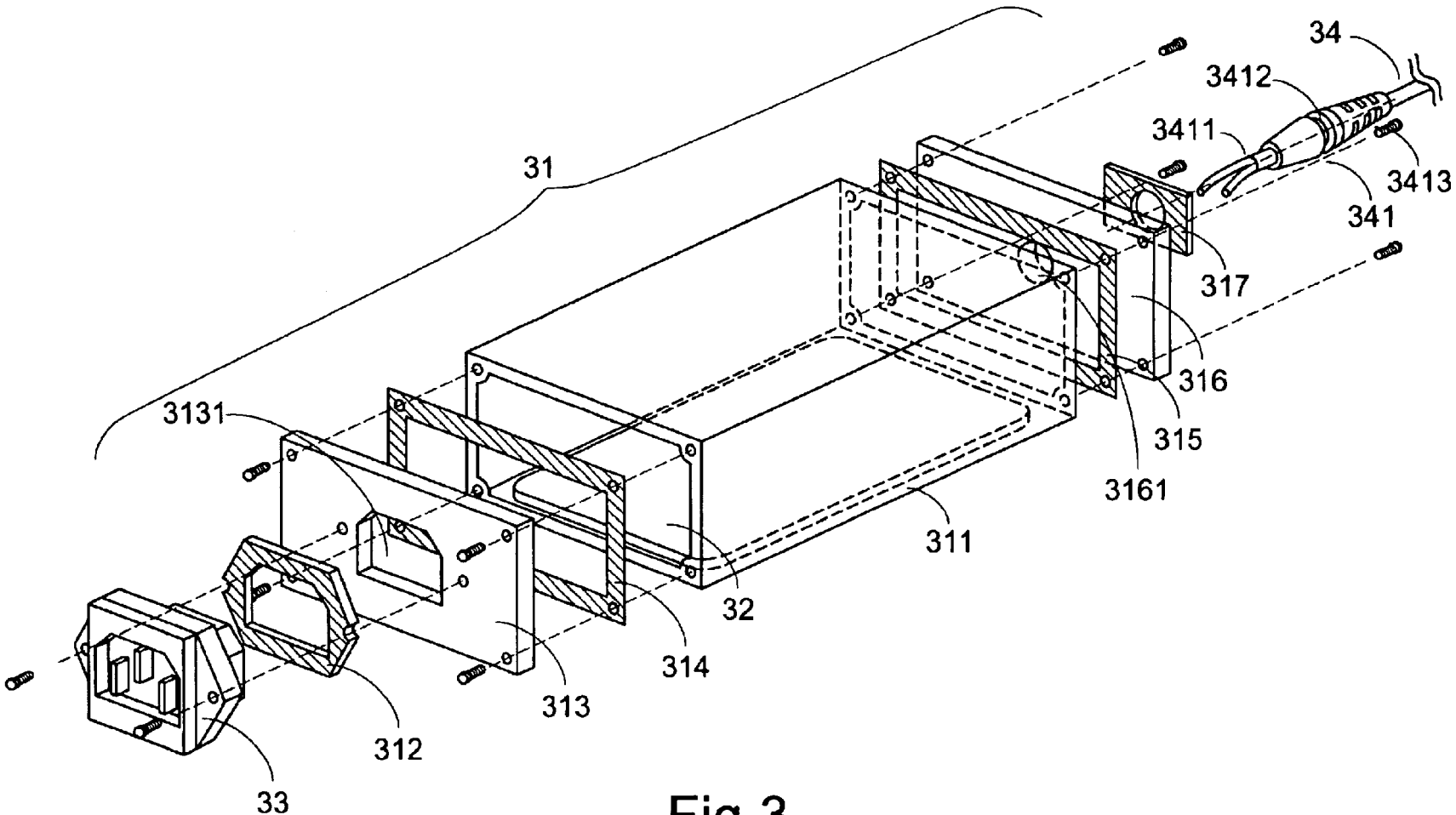
FIG. 3 is a decomposed diagram illustrating a preferred embodiment of an assembly structure of an adapter according to the present invention.

Please refer to FIG. 3 which is a decomposed diagram illustrating a preferred embodiment of an assembly structure of an adapter according to the present invention. As shown in FIG. 3, the adapter includes a waterproof and heat-dissipating structure 31, a circuit board 32, a socket 33 and a power cord 34. The waterproof and heat-dissipating structure 31 further includes an aluminum-wrapped housing 311, a socket pad 312, a first lateral plate 313, a first spacer 314, a second spacer 315, a second lateral plate 316 and a power cord pad 317.

Figure 4:
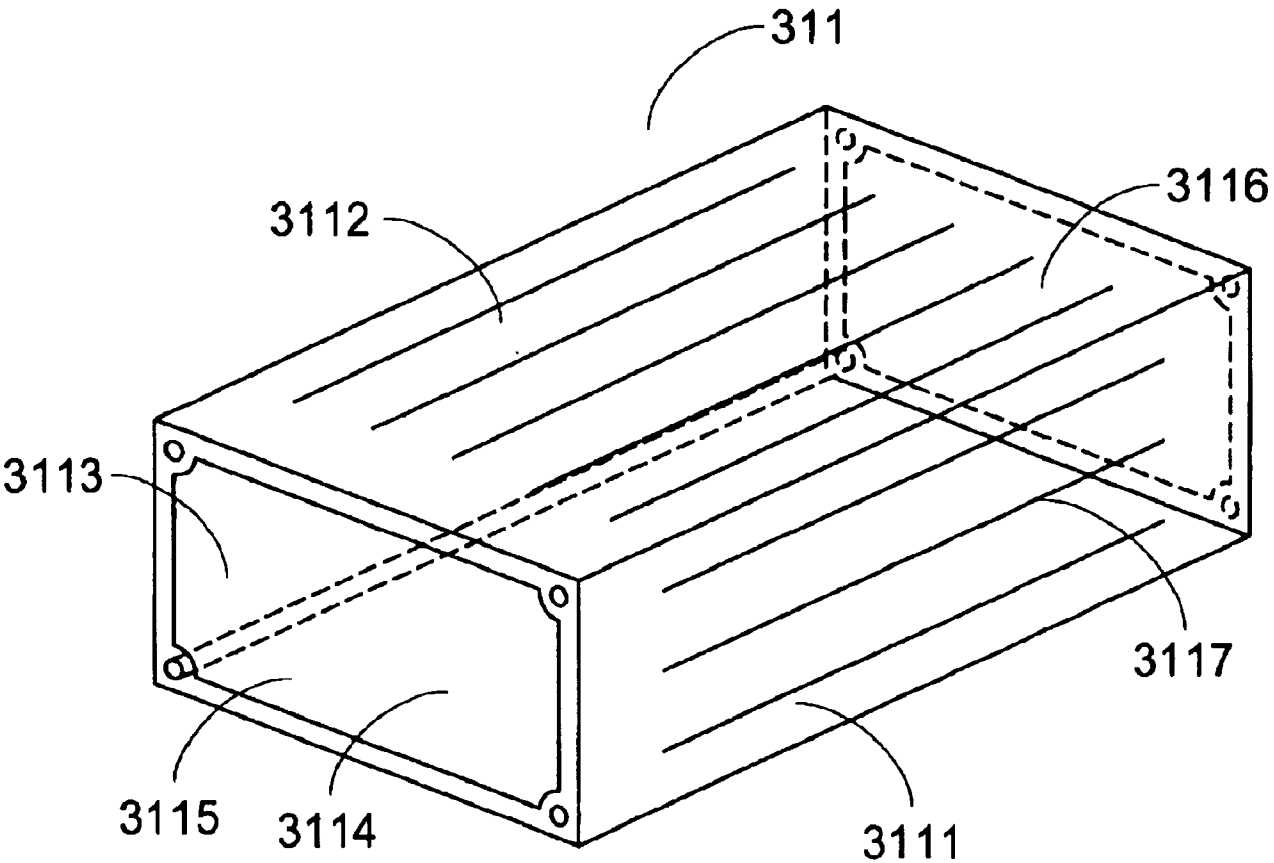
FIG. 4 is a structure diagram illustrating the aluminum-wrapped housing of FIG. 3.

Please refer to FIG. 4. The aluminum-wrapped housing 311 is an aluminum squeezing-type housing and is integrally formed. The aluminum-wrapped housing 311 includes four adjoining surfaces 3111, 3112, 3113 and 3114, for defining a space therein and two opening ends 3115 and 3116. The space is used for accommodating the circuit board 32. In addition, the aluminum-wrapped housing 31 optionally includes a plurality of dents or fins 3117 on the surfaces 3111, 3112, 3113 and 3114 for increasing the heat-dissipating area. Then, the heat generated from the electronic devices of the circuit board 32 can be efficiently and quickly conducted to air.

Please refer to FIG. 3 again. The first lateral plate 313 includes a hole 3131 for fixing the socket 33 therein. In this embodiment, the socket 33 is fixed to the first lateral plate 313 by screwing. In addition, the first lateral plate 313 is fixed to the aluminum-wrapped housing 311 by screwing and tightly covers the opening end 3115. Certainly, the method for fixing the socket 33 to the first lateral plate 313 or the first lateral plate 313 to the aluminum-wrapped housing 311 can also be implemented by engaging.

Similarly, the second lateral plate 316 includes a hole 3161 for fixing a terminal 341 of the power cord 34 therein. The terminal 341 is fixed to the second lateral plate 316 by engaging. The terminal 341 includes an electrical connecting end 3411, a groove 3412 and a buffer portion 3413 and the groove 3412 is disposed between the electrical connecting end 3411 and the buffer portion 3413. When the terminal 341 inserts into the hole 3161 of the second lateral plate 316, the electrical connecting end 3411 is electrically connected to the circuit board 32 and the groove 3412 of the terminal 341 is engaged to the edge of the hole 3161 for fixing the power cord 34. In addition, the second lateral plate 316 can be fixed to the aluminum-wrapped housing by screwing or by engaging for tightly covering the opening end 3116.

Please refer to FIG. 3. For further enhancing the waterproof function of the adapter, spacers 314 and 312 are optionally disposed between the aluminum-wrapped housing 31 and the first lateral plate 313 and between the first lateral plate 313 and the socket 33, respectively, for preventing from the gap generation. Likewise, spacers 315 and 317 are optionally disposed between the aluminum-wrapped housing 31 and the second lateral plate 316 and between the second lateral plate 316 and the terminal 341 of the power cord 34, respectively. Hence, the gap generation is avoided when the second lateral plate 316 and the power cord 34 are fixed to the aluminum-wrapped housing 31 and the second lateral plate 316, respectively, resulting in better waterproof effect.

Figure 5:
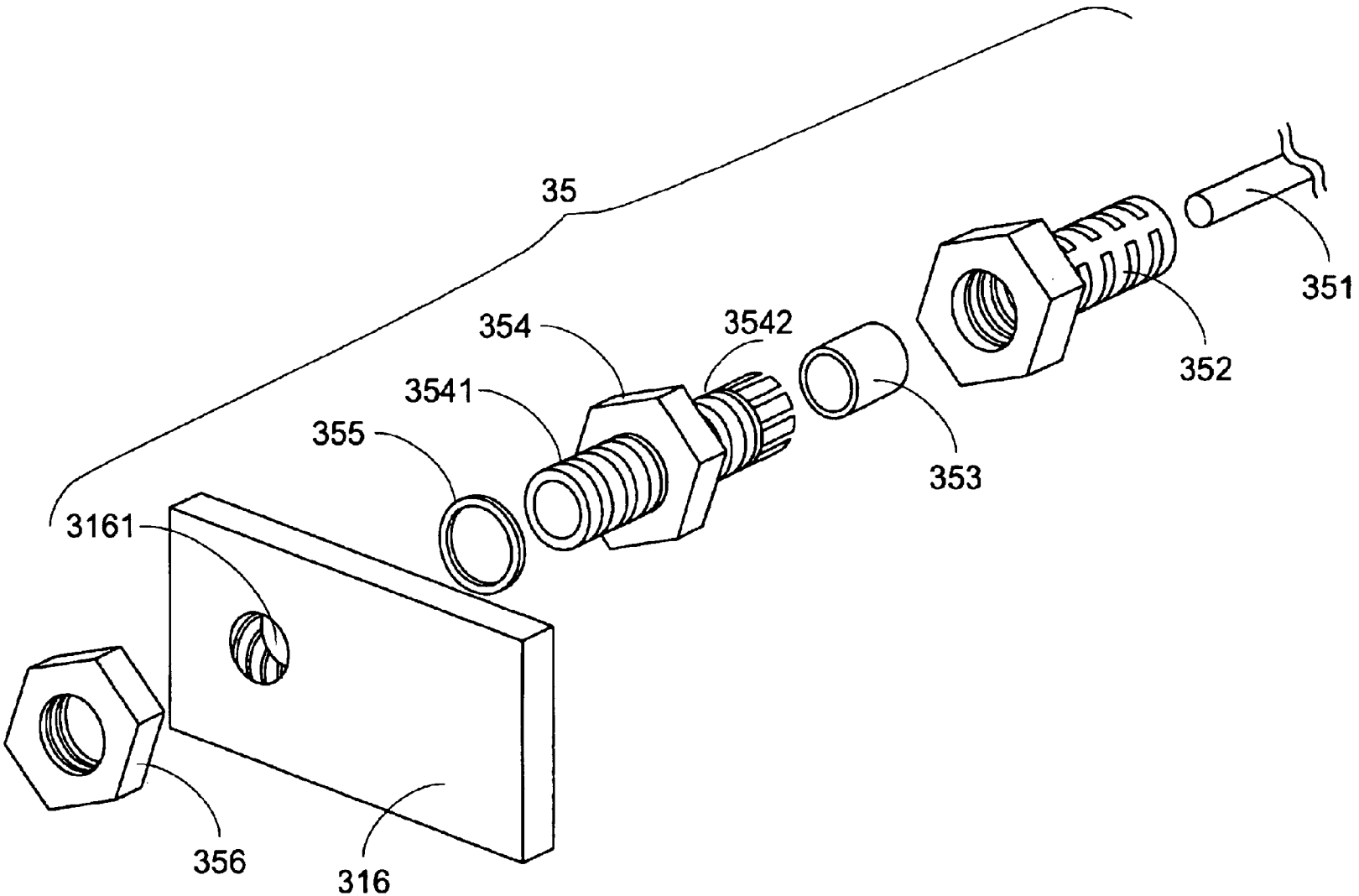
FIG. 5 is a decomposed diagram illustrating a preferred embodiment of an assembly structure of a power cord and a second lateral plate in an adapter according to the present invention.

Please refer to FIG. 5 which is a decomposed diagram illustrating a preferred embodiment of an assembly structure of a power cord and a second lateral plate in an adapter according to the present invention. As shown in FIG. 5, the second lateral plate 316 includes the hole 3161 thereon and the power cord 34 includes a waterproof structure 35. The waterproof structure 35 includes a wire material 351, a first nut 352, a soft washer 353, a connecting element 354, a spacer 355 and a second nut 356. The wire material 351 passes through the channel of the first nut 352 to be further sleeved with soft washer 353. The connecting element 354 includes two connecting ends 3541 and 3542, which have the outer thread thereon. The first nut 352 has the inner thread on the inner surface of the channel matching with the outer thread of the connecting end 3542. When the wire material 351 sleeves with the connecting end 3542 of the connecting element 354 via the soft washer 353 and the first nut 352 screws with the connecting end 3542, the wire material 351 is stably and tightly fixed to the connecting element 354. Subsequently, the connecting end 3541 of the connecting element 354 passes through the spacer 355 and the hole 3161 of the second lateral plate 316 in sequence and is screwed with the second nut 356 together, whereby fixing the power cord 34 to the second lateral plate 316. Then, the power cord 34 is electrically connected to the circuit board 32 (not shown in FIG.). The spacer 355 is used for preventing a gap from being generated between the connecting element 354 and the second lateral plate 316. Since the soft washer 353 and the spacer 355 applied in the waterproof structure, the waterproof effect can be efficiently achieved.

Certainly, in the above embodiment, the inner threads of the first nut 352 or the second nut 356 can be replaced by a plurality of circle grooves and the outer threads of the connecting ends 3541 and 3542 of the connecting element 354 can be replaced by a plurality of circle protrusions. The first nut 352 and the second nut 356 can be fixed to the connecting ends 3542 and 3541 by engaging, respectively.

Figure 6:
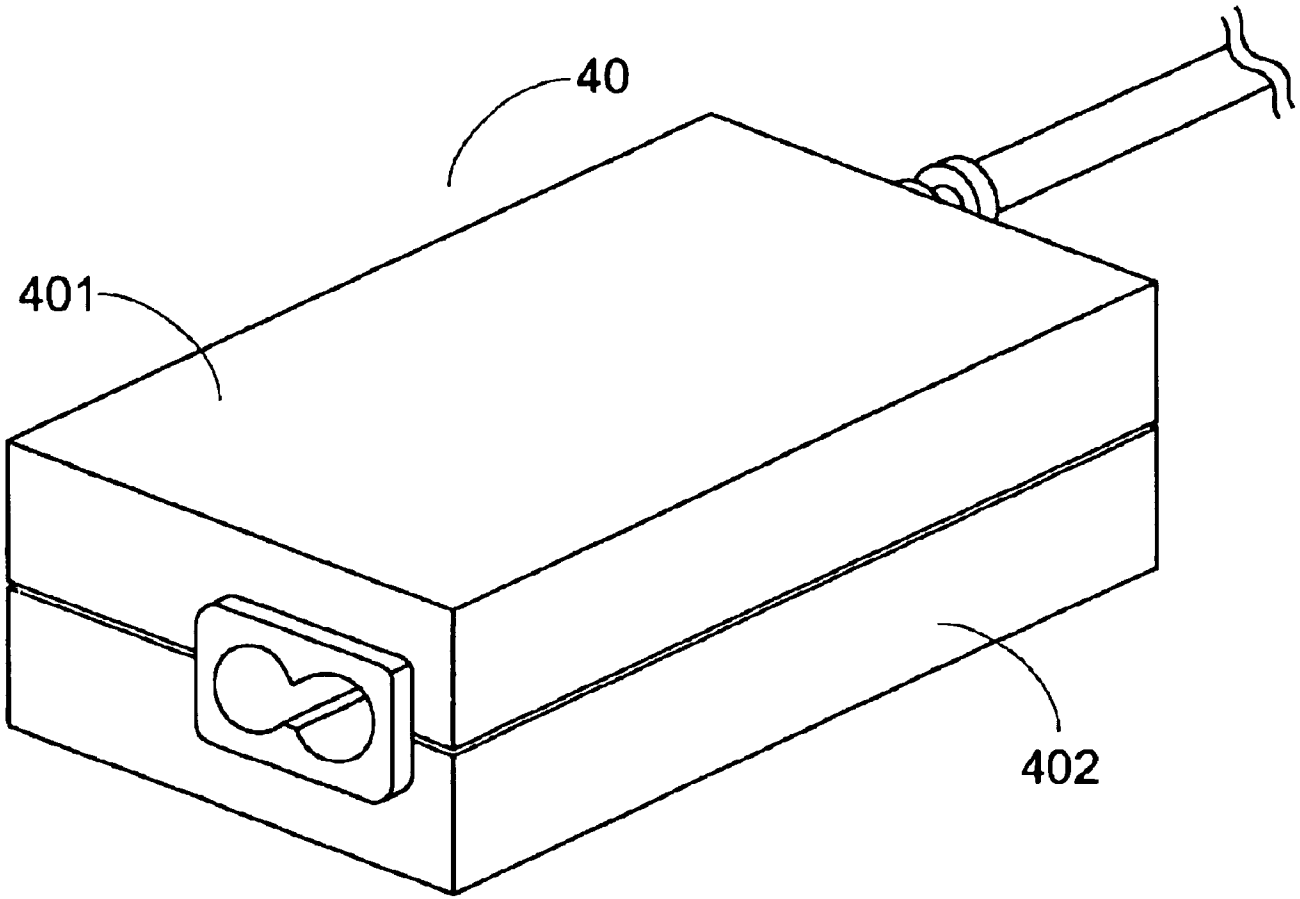
FIG. 6 is a diagram illustrating another preferred embodiment of an assembly structure of an adapter according to the present invention.
Figure 7:
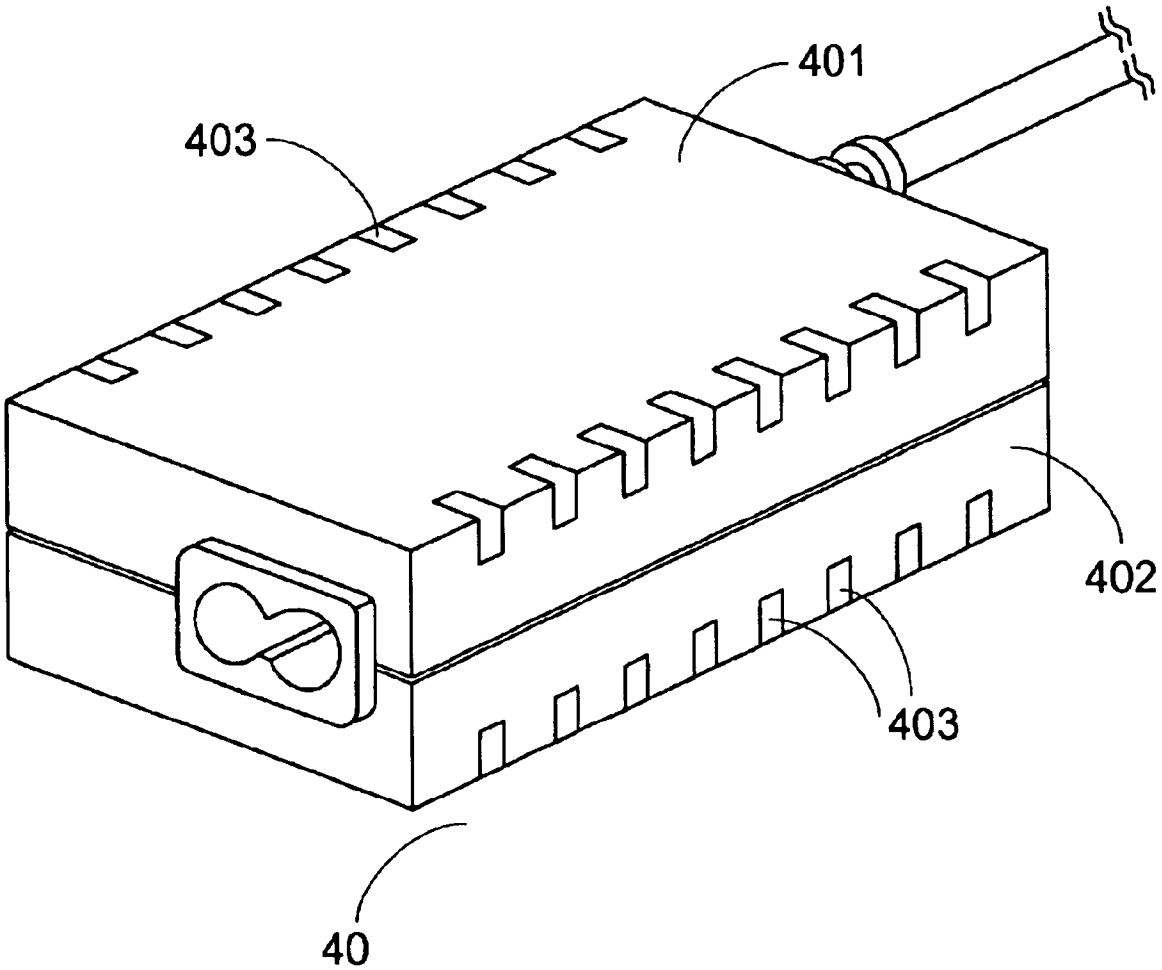
FIG. 7 is a diagram illustrating a further preferred embodiment of an assembly structure of an adapter according to the present invention.

In addition, an outer covering 40 covers the aluminum-wrapped housing 31, the first lateral plate 313 and the second lateral plate 316 as shown in FIG. 6. The outer covering 40 includes a top cover 401 and a base 402 for achieving scald-proof effect. Furthermore, the outer covering 40 can further include a plurality of holes 403 on the top cover 401 and the base 402 for enhancing dissipating heat as shown in FIG. 7.

Moreover, in another preferred embodiment, an aluminum-wrapped housing as shown in FIG. 4 is disposed between the circuit board and the case of the conventional adapter. The socket and the power cord are fixed in the holes of the case, respectively. In such way, the modified adapter also has better waterproof and heat-dissipating effects comparing with the conventional one.

In the above embodiments, the heat-dissipating effect is significantly improved besides the waterproof effect. Table 1 shows that the comparison of the heat-dissipating effect between the preferred embodiments of the adapter according to the present invention and the conventional adapter.

TABLE 1

Comparison of the heat-dissipating effect between the conventional adapter and the preferred embodiment of the adapter of the present invention.

| | Top surface temp. Tcase (top) | | | Bottom temp. Tcase (bottom) | | | Max. | Heat- |
|---|---|---|---|---|---|---|---|---|
| | Min. temp. | Avg. Temp. | Max. Temp. | Min. Temp. | Avg. Temp. | Max. Temp. | Internal Temp. | dissipating Effect |
| A | 66.4 | 77.3 | 83.3 | 70.9 | 88.8 | 100.0 | 113.7 | worse |
| B | 76.8 | 77.2 | 77.4 | 77.1 | 77.7 | 78.8 | 103.1 | better |
| C | 74.9 | 75.2 | 75.4 | 75.2 | 76.1 | 76.7 | 101.2 | better |
| D | 60.4 | 76.9 | 79.2 | 64.9 | 81.4 | 83.6 | 108.0 | better |
| E | 65.6 | 75.9 | 77.2 | 65.8 | 78.1 | 79.7 | 106.0 | better |

Remark
1. The measure method for the embodiments is to place the adapter on a test board, wherein the distance between the adapter and the test board is at least 1 mm.
2. The above tests are proceeded at the same condition.

In Table 1, A represents the conventional adapter; B represents the preferred embodiment of the adapter with the aluminum-wrapped housing in FIG. 3; C represents the preferred embodiment of the adapter with the aluminum-wrapped housing having the dents or fins thereon as shown in FIG. 4; D represents the preferred embodiment of the adapter with the aluminum-wrapped housing and the outer covering of FIG. 6; and E represents the preferred embodiment of the adapter with both aluminum-wrapped housing and the outer covering having heat-dissipating holes thereon as shown in FIG. 7. The result shown in Table 1 indicates that the heat-dissipating effects of the adapters B~E according to the present invention are significantly better than that of the conventional adapter A. In addition, the heat-dissipating effect is C>B>E>D. In other words, the adapter with the aluminum-wrapped housing having the dents or fins has the better heat-dissipating effect. When the adapter includes the outer covering, the outer covering having the heat-dissipating holes has the better heat-dissipating effect.

To sum up, an adapter including an aluminum-wrapped housing according to the present invention can not only increase heat-dissipating but also improve waterproof effect. Since aluminum has high conductive property, the temperature of the housing of the adapter can easily achieve a homogenous temperature.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A waterproof and heat-dissipating structure of an electronic apparatus including a circuit board, an input element and an output element, comprising:

an aluminum-wrapped housing having at least four adjoining surfaces for defining a space, a first opening end and a second opening end, wherein said space is used for accommodating said circuit board;

a first lateral plate fixed to said aluminum-wrapped housing, covering said first opening end and having a first hole for fixing said input element therein; and a second lateral plate fixed to said aluminum-wrapped housing, covering said second opening end and having a second hole for fixing said output element therein, wherein said output element has a groove for engaging with an edge of said second hole when said output element inserts into said second hole to fix said output element therein.

2. The waterproof and heat-dissipating structure according to claim 1 wherein said input element is one selected from a group consisting of a power cord, a plug and an outlet.

3. The waterproof and heat-dissipating structure according to claim 1 wherein said output element is one selected from a group consisting of a power cord, a plug and an outlet.

4. The waterproof and heat-dissipating structure according to claim 1 wherein said electronic apparatus is one selected from a group consisting of an adapter, a battery charger and a transformer.

5. The waterproof and heat-dissipating structure according to claim 1 wherein said surfaces of said aluminum-wrapped housing further have one of dents and fins thereon.

6. The waterproof and heat-dissipating structure according to claim 1 wherein said first lateral plate is fixed to said aluminum-wrapped housing by screwing for tightly covering said first opening end.

7. The waterproof and heat-dissipating structure according to claim 1 wherein said second lateral plate is fixed to said aluminum-wrapped housing by screwing for tightly covering said second opening end.

8. The waterproof and heat-dissipating structure according to claim 1 further comprising an input element spacer disposed between said input element and said first lateral plate for avoiding forming a gap between said input element and said first hole.

9. The waterproof and heat-dissipating structure according to claim 1 further comprising a first lateral plate spacer disposed between said first lateral plate and said aluminum-wrapped housing for avoiding forming a gap therebetween.

10. The waterproof and heat-dissipating structure according to claim 1 further comprising an output element spacer disposed between said output element and said second lateral plate for avoiding forming a gap between said output element and said second hole.

11. The waterproof and heat-dissipating structure according to claim 1 further comprising a second lateral plate spacer disposed between said second lateral plate and said aluminum-wrapped housing for avoiding forming a gap therebetween.

12. The waterproof and heat-dissipating structure according to claim 1 wherein said input element is fixed to said first lateral plate by screwing for tightly fastening said input element therein.

13. The waterproof and heat-dissipating structure according to claim 1 wherein said output element is engaged and said aluminum-wrapped housing is an aluminum squeezing-type housing, which is integrally formed.

14. The waterproof and heat-dissipating structure according to claim 1 further comprising an outer covering for covering said aluminum-wrapped housing, said first lateral plate and said second lateral plate.

15. The waterproof and heat-dissipating structure according to claim 14 wherein said outer covering includes a top cover and a base.

16. The waterproof and heat-dissipating structure according to claim 14 wherein said outer covering has a plurality of heat-dissipating holes on an outer surface thereof.

17. A waterproof and heat-dissipating structure of an electronic apparatus including a circuit board, an input element and an output element, comprising:

an aluminum-wrapped housing having at least four adjoining surfaces for defining a space, a first opening end and a second opening end, wherein said space is used for accommodating said circuit board;

a first lateral plate fixed to said aluminum-wrapped housing, covering said first opening end and having a first hole for fixing said input element therein;

a second lateral plate fixed to said aluminum-wrapped housing, covering said second opening end and having a second hole for fixing said output element therein wherein said output element has a groove, for engaging with an edge of said second hole when said output element inserts into said second hole to fix said output element therein; and a spacer disposed between said aluminum-wrapped housing and one of said first lateral plate and said second lateral plate for avoiding forming a gap therebetween.

18. A waterproof and heat-dissipating structure of an electronic apparatus including a circuit board, an input element and an output element, comprising:

an aluminum-wrapped housing having at least four adjoining surfaces for defining a space, a first opening end and a second opening end, wherein said space is used for accommodating said circuit board;

a first lateral plate fixed to said aluminum-wrapped housing, covering said first opening end and having a first hole for fixing said input element therein; and a second lateral plate fixed to said aluminum-wrapped housing, covering said second opening end and having a second hole for fixing said output element therein, wherein said output element includes a waterproof structure at a power cord end and said waterproof structure comprises:

a first nut having a channel and an inner thread;

a soft washer;

a wire material having one end to pass through said channel of said first nut for sleeving with said soft washer;

a connecting element having a first and a second connecting ends, wherein said second connecting end connected to said wire material by said soft washer and to said first nut by screwing, whereby tightly fixing said wire material to said connecting element and having waterproof effect; and a second nut connected to said first connecting end of said connecting element, which first passes through said second hole of said second lateral plate, by screwing, whereby tightly fixing said output element to said second lateral plate and having waterproof effect.

19. The waterproof and heat-dissipating structure according to claim 18 wherein said waterproof structure at said power cord end further comprises a connecting spacer disposed between said connecting element and said second lateral plate for avoiding forming a gap.

* * * * *